US005688213A

United States Patent [19]

Recker

[11] Patent Number: 5,688,213

[45] Date of Patent: Nov. 18, 1997

[54] EXERCISE APPARATUS

[76] Inventor: Mark L Recker, 7430 W. Jefferson, Fort Wayne, Ind. 46804

[21] Appl. No.: 731,259

[22] Filed: Oct. 11, 1996

[51] Int. Cl.[6] ..... A63B 21/02

[52] U.S. Cl. ..... 482/125; 482/139; 482/79

[58] Field of Search ..... 482/79, 124, 125, 482/139, 121, 122; 602/61, 65

[56] References Cited

U.S. PATENT DOCUMENTS

| | | | |
|---|---|---|---|
| 843,478 | 2/1907 | Müller . | |
| 866,495 | 9/1907 | Marks . | |
| 1,194,884 | 8/1916 | Sandow . | |
| 2,484,130 | 10/1949 | Thibault | 602/65 |
| 3,162,441 | 12/1964 | Karlik . | |
| 3,162,442 | 12/1964 | Karlik . | |
| 4,245,840 | 1/1981 | Van Housen . | |
| 4,345,590 | 8/1982 | Nakajima | 602/65 |
| 4,685,671 | 8/1987 | Hagerman et al. | 482/124 |
| 5,062,642 | 11/1991 | Berry et al. | 482/139 |
| 5,100,129 | 3/1992 | Porter et al. | 482/125 |
| 5,137,272 | 8/1992 | Wilkinson . | |
| 5,306,222 | 4/1994 | Wilkinson . | |
| 5,372,565 | 12/1994 | Burdenko . | |
| 5,518,486 | 5/1996 | Sheeler | 482/139 |
| 5,582,579 | 12/1996 | Chism et al. | 482/79 |

*Primary Examiner*—Lynne A. Reichard
*Attorney, Agent, or Firm*—O'Malley and Firestone

[57] ABSTRACT

The exercise apparatus of the invention has a stirrup and an anklet. The stirrup has a lateral strap that extends laterally from the stirrup. The anklet has ankle straps that cross in back of the foot and removably attach in the front of the leg above the ankle. The apparatus has an elastic cord connected to the lateral strap and a handle. The handle can have a rotatable grip which allows the user to change hand positions and vary the type of exercise performed.

18 Claims, 5 Drawing Sheets

EXERCISE APPARATUS

BACKGROUND OF THE INVENTION

1. Field of the Invention

The present invention relates to an exercise apparatus suitable for exercising and conditioning the upper and lower human body.

2. Description of the Prior Art

Regular physical exercise benefits the human body. Exercise strengthens and tones muscles, including the cardiovascular system. It helps regulate weight and cholesterol levels. Exercise may relieve stress and provide for psychological well-being.

Although the benefits of exercise are well known, people tend to neglect regular exercise. People often have limited time to exercise, especially for a whole body workout. A whole body workout frequently requires joining a gym, taking exercise classes, buying expensive and cumbersome exercise machines or relying on calisthenics. One may squeeze in a walk or jog to work the lower body and cardiovascular system. The upper body, however, is not exercised.

Maintaining a regular exercise program when traveling presents additional problems. One must either rely on the accommodations available, often using strange equipment or participating in unfamiliar classes or forgo a workout.

In the alternative, one can carry portable exercise equipment when traveling. Portable exercise equipment tends to exercise only part of the body, failing to give a whole body workout. Furthermore, this portable exercise equipment is often inconvenient to tote along on a trip. Dumbbells, for example, primarily exercise the upper torso and arms. Stair steps primarily condition the leg and enhance cardiovascular conditioning. Although dumbbells and stair steps are portable and require little room to use, they are awkward to lug during a trip. Jump ropes are portable, yet their use may require more coordination than some people have. Moreover, jumping rope requires space for clearance and a flexible surface to protect the joints.

Therefore, exercising with a simple, safe and portable exerciser that gives both an upper body and lower body workout may help people maintain a regular exercise regimen.

Resistance type exercise devices can offer portability, simplicity of use and the benefit of a whole body workout. Some resistance type devices, however, attach an elastic cord to an ankle cuff or a hand cuff that creates stress on the ankle or wrist. This stress can cause strain and dislocations. If the cuffs do not fit well or tightly, the ankle and hand cuffs can rotate, rub and slip around the joint or limb, causing rubbing, blistering and other discomfort.

Exercise devices that use a nonanchored stirrup can also cause problems while exercising. By itself, a stirrup shifts and rotates on the foot during exercise. When pulled up and/or forward during exercise, the stirrup can pull forward and rotate toward the middle of the foot. When released, the stirrup slides back and rotates laterally. This movement creates pressure points from the stress on the foot, adds friction from the rubbing against the foot and causes discomfort while exercising.

Furthermore, attaching a cord to a hand cuff or a stationary hand grip prevents the user from changing his hand position to alter the type of exercise and adjust the apparatus for his body type. This limits the number of available exercises. The stationary hand grip can also generate friction against the hand to cause blisters and calluses. The stationary grip increases hand fatigue and digging into the palm with the fingernails when exercising.

Some resistance type exercise devices incorporate waist belts to anchor or align the arm and leg exercise portions of the devices. These waist belts restrict or prevent cross and lateral motions during exercise.

Because a person is unlikely to continue an exercise program based on uncomfortable or difficult to use equipment, one goal of the invention is to develop an exercise apparatus that is easy and comfortable to use.

Another goal of the invention is to develop an exercise apparatus that is truly portable and can exercise both the upper and lower body simultaneously.

Another goal of the invention is to develop an exercise apparatus that adjusts to a user's foot size.

A further goal of the invention is to develop an exercise apparatus that can be used with a variety of exercises.

SUMMARY OF THE INVENTION

An exercise apparatus of the invention has a stirrup and an anklet. The stirrup can be one piece that fits around the arch of the foot. Preferably the stirrup has an arch section and inner and outward stirrup straps. The arch section is defined by substantially parallel lateral and medial ankle straps substantially perpendicularly affixed to the arch section. An inner stirrup strap is collinear to the arch section at the medial ankle strap while an outward stirrup strap is substantially perpendicular to a lateral strap and opposite the ankle straps. The lateral strap is collinear to the arch section at the lateral ankle strap. The exercise apparatus also has a handle, and an elastic cord fastened between the handle and the lateral strap.

Another exercise apparatus of the invention comprises a foot piece having an anklet and a stirrup. The anklet has medial and lateral ankle straps affixed to their respective sides of the stirrup. The ankle straps cross behind the ankle and removably attach together in the front of the leg above the ankle. A lateral strap extends laterally from the stirrup. An elastic cord is fastened between a handle and a handle strap and the lateral strap.

The stirrup preferably has an arch section which is defined by the lateral and medial ankle straps. The stirrup also has an inner stirrup strap extending from the medial side of the arch section toward the top of a foot and an outward stirrup strap extending from the lateral side of the arch section toward the top of the foot. The inner and outer stirrup straps removably attach together on top of the foot. A lateral strap extends laterally from the stirrup.

Additional effects, features and advantages will be apparent in the written description that follows.

DETAILED DESCRIPTION OF THE INVENTION

Referring to the figures, the exercise apparatus of the invention has a foot piece with both a stirrup and an anklet. Although the stirrup can be one piece that fits on the foot at the arch, it is preferably made from an arch section and stirrup straps so that it readily adjusts to fit the particular user's foot.

Figure 1:
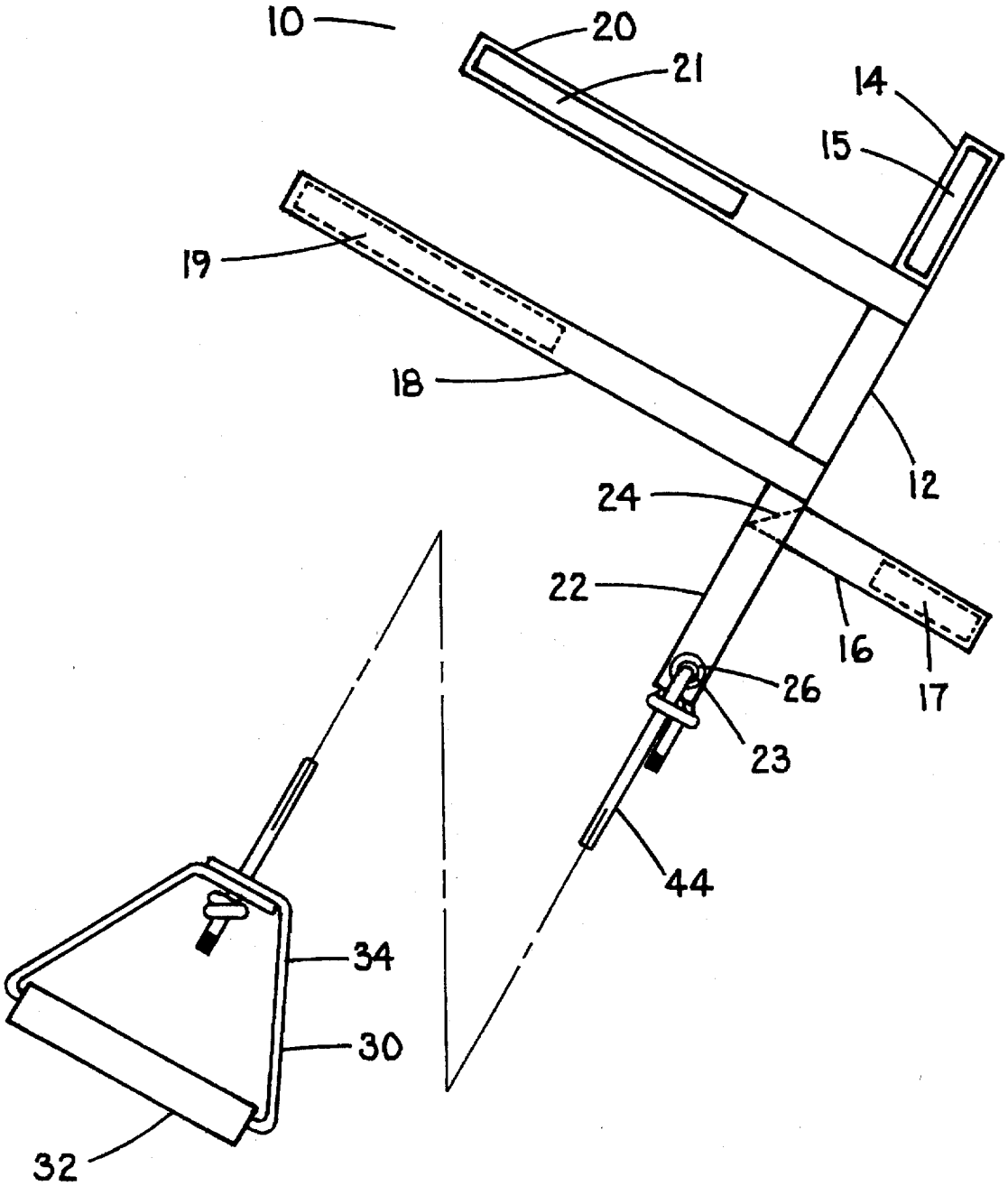
FIG. 1 is a plan view of an exercise apparatus of the invention.

Referring to FIG. 1 for an adjustable stirrup, the exercise apparatus has an arch section 12 defined by substantially parallel medial and lateral ankle straps 16, 18 substantially perpendicularly affixed to arch section 12. A lateral strap 22 and an inner stirrup strap 14 are collinear to arch section 12 and an outward stirrup strap 16 is substantially perpendicular to arch section 12 and opposite lateral and medial ankle straps 16, 18. The arch section 12, lateral strap 22 and inner stirrup strap 14 can consist of two or more straps collinearly attached. The outward stirrup strap 16 is substantially perpendicularly attached to arch section 12 or lateral strap 22.

Figure 5:
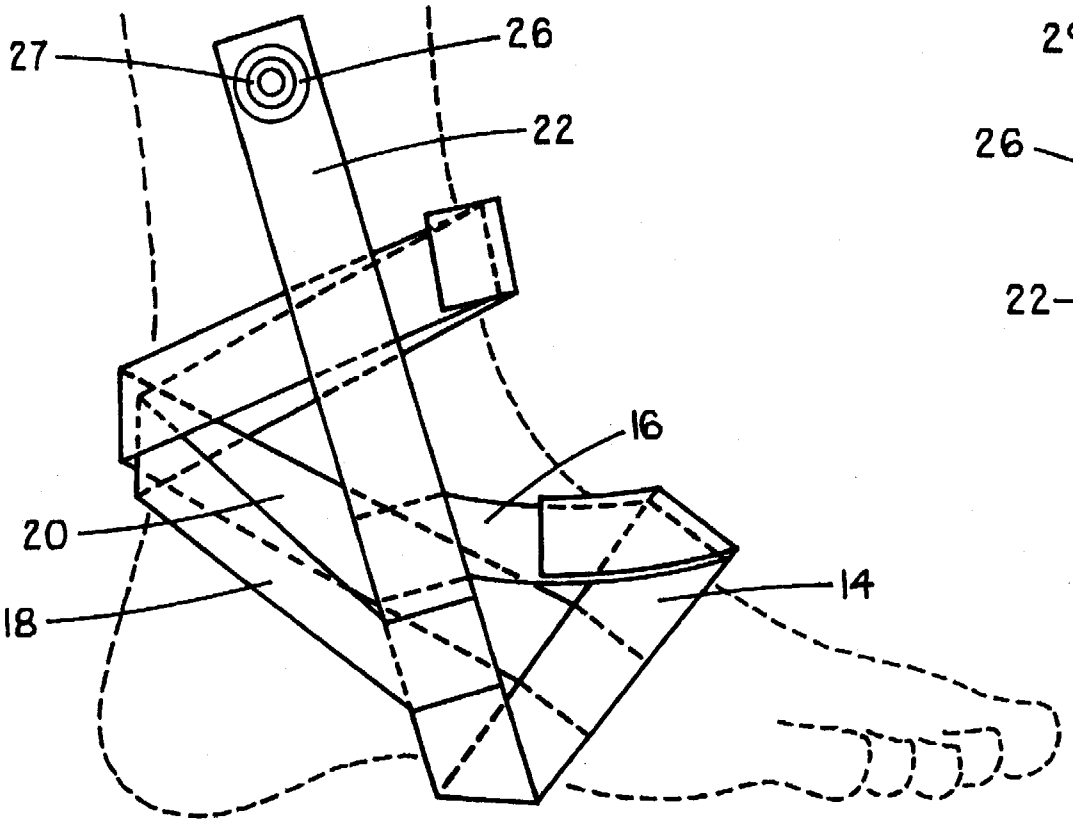
FIG. 5 is a front view of a foot piece of an exercise apparatus of the invention shown.
Figure 7:
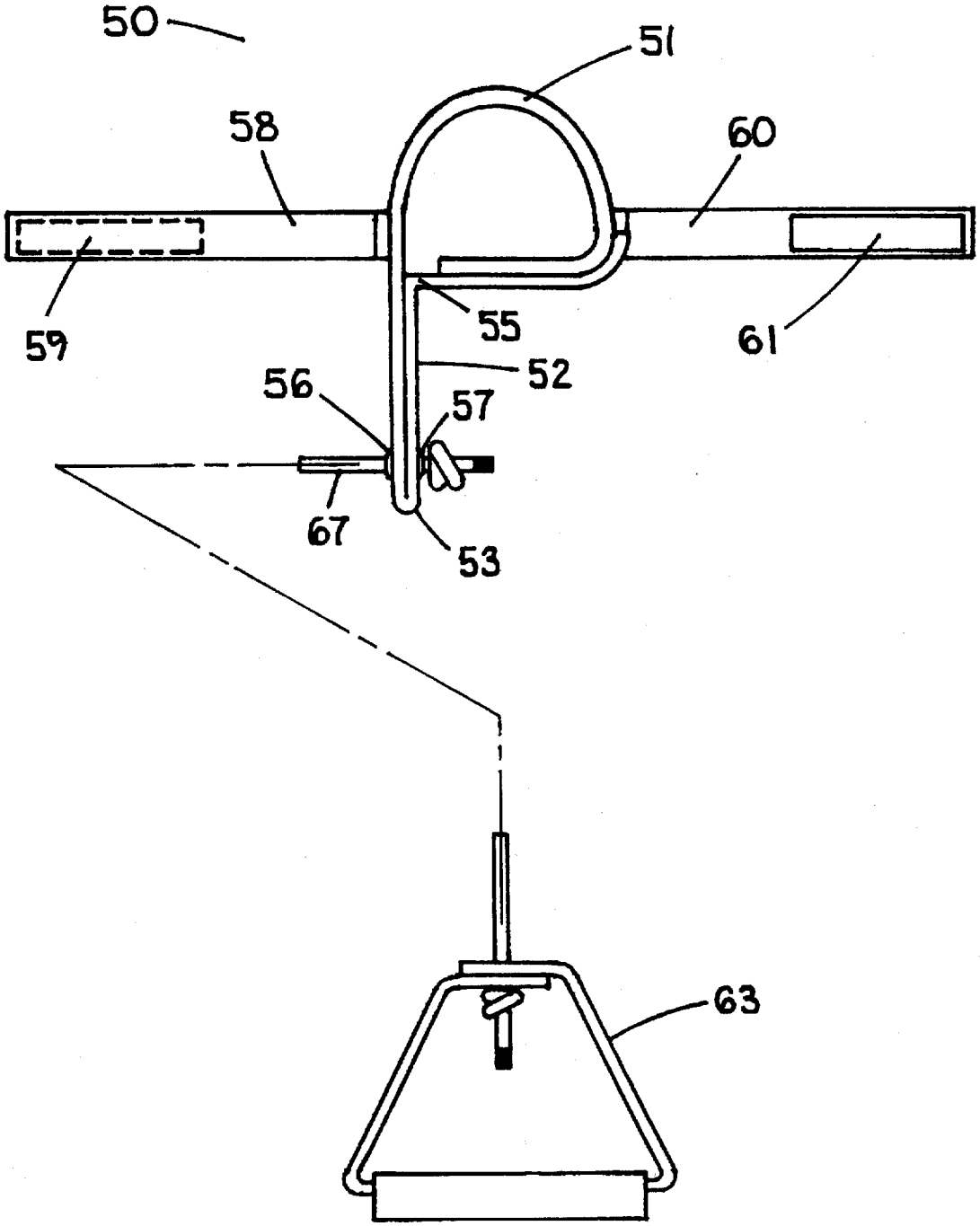
FIG. 7 is a plan view of an exercise apparatus of the invention with the ankle straps folded flat.

Preferably, the arch section, lateral strap and the inner stirrup strap are made from one blank strap. Making the lateral strap with two sections of strap material is also preferable. More preferably as shown in FIGS. 5 and 7, a folded lateral strap 22, 52 forms by folding the free end distal to the inner stirrup strap of a blank strap or a blank lateral strap back onto itself a sufficient length to the desired size to produce two sections of material. The resulting fold 29, 53 is distal to the arch section 12 or the stirrup 51. The free end of the lateral strap 22, 52 then fastens 25, 55 at the outward stirrup strap 16, one piece stirrup 51 or lateral strap 52.

The outward stirrup strap 16 is preferably made from the free end of the lateral strap 22 as shown in FIG. 1. The desired length of the lateral strap end is folded 24 so that the outward stirrup strap 16 is substantially perpendicular to the lateral strap 22 and the arch section 12. The outward stirrup strap 16 then fastens to the lateral strap.

The stirrup should be sized to fit comfortably on the foot while allowing minimal rotation while exercising. The length of the arch section ranges from about 5 to about 9 inches long. The inner and outward stirrup straps are long enough to wrap comfortably over the top of the foot, generally about 3 to about 6 inches. The length of the lateral strap is about 2 to about 7 inches.

Referring to both FIG. 1 for an adjustable stirrup and FIG. 7 for a one piece stirrup, the lateral 18, 58 and medial 20, 60 ankle straps are substantially perpendicularly affixed to the arch section 12 or one piece stirrup 51. The ankle straps should be long enough to be comfortable to wear when wrapped around the ankle as described below, usually about 10 to about 18 inches. Although the ankle straps can be the same length, preferably, either the lateral ankle strap or the medial ankle strap is longer than the other ankle strap, more preferably about 1 to about 2.5 inches longer.

The lateral, stirrup and ankle straps are made from strong flexible material that can withstand a load while exercising. The material should resist tearing and the appropriate types are well known in the exercise and recreation fields. The material is preferably a nonelastic material, such as leather, canvas or vinyl and more preferably a synthetic material or blend such as nylon webbing.

To fit comfortably while exercising, especially when worn inside a shoe, the lateral, stirrup and ankle straps are attached by any means that gives a relatively flat attachment, such as gluing, sewing or fusing, preferably by sewing.

Figure 4:
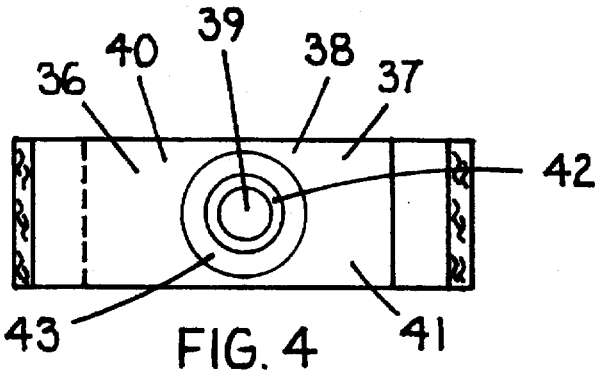
FIG. 4 is a perspective view of a handle looking up from line b–b'.
Figure 3:
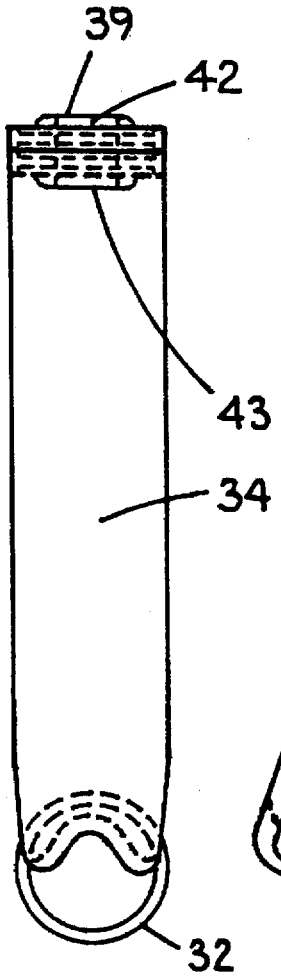
FIG. 3 is a cross-sectional view of a handle along line a–a'.
Figure 2:
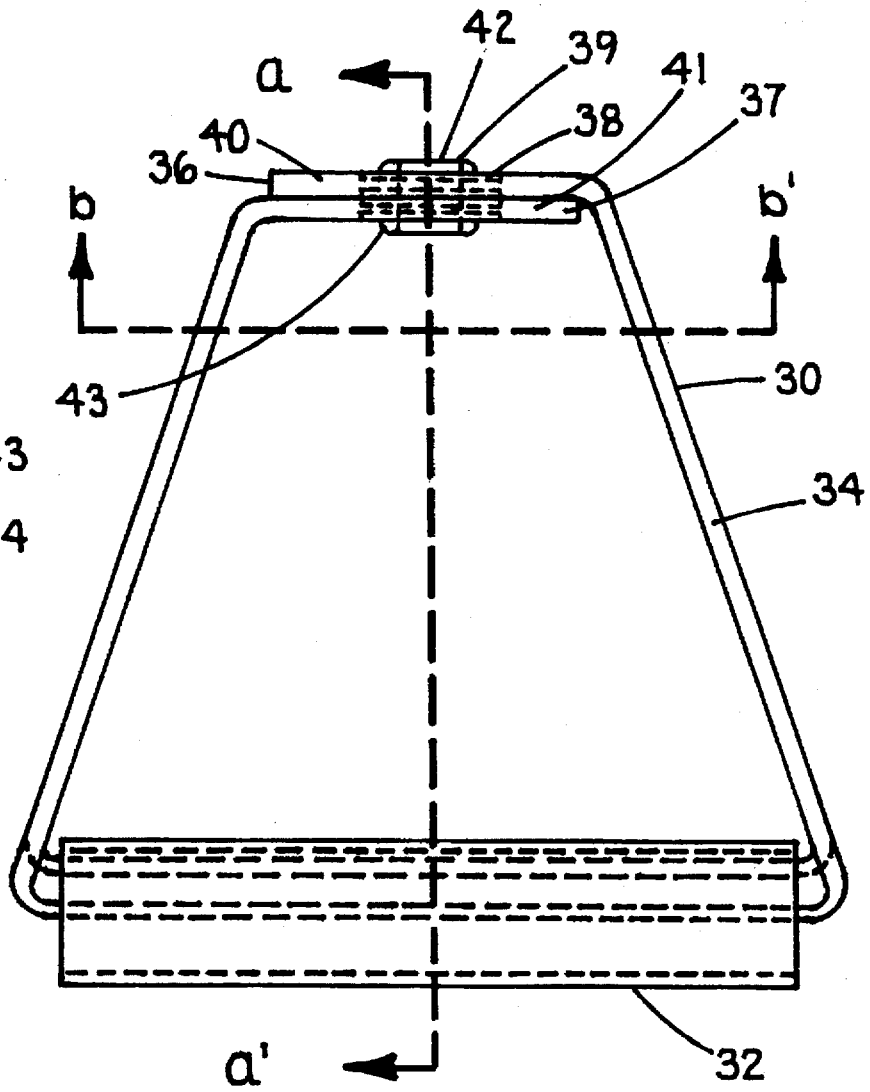
FIG. 2 is a plan view of a handle.

The exercise apparatus has a handle 30, 63. As shown in FIGS. 2 and 3, the handle 30 preferably has a rotatable grip 32 that rotates about a handle strap 34. FIG. 4 shows the overlapped ends 40, 41 of the handle strap 34 which are joined at ends 36, 37, such as by gluing, fusing or sewing, preferably by sewing. These overlapped ends are preferably joined in a manner that leaves the overlapped handle strap material 38 between the affixed ends unattached.

An elastic cord 44, 67 or strap is attached to the foot piece 10, 50 at one end and the handle 30, 63 at the other. For the user's safety, the elastic cord should not be easily removed. The elastic cord 44, 67 is preferably threaded through openings 23, 39, such as a grommet, eyelet, loop, and the like, of the foot piece and the handle and secured, such as by knotting. The elastic cord 44, 67 is attached to one end to the lateral strap 22, 52. When the overlapped handle strap material 38 is unattached, the handle 30 can have two reinforced openings for the elastic cord, such as grommets 42, 43, on each end of the handle strap. Likewise, when the lateral strap has two sections of strap material, it can have two reinforced openings for the elastic cord, such as by using grommets 26, 27, 56, 57 on each side of the fold. Therefore, if one grommet fails during use, the other grommet prevents the cord from recoiling and hitting the user.

Figure 6:
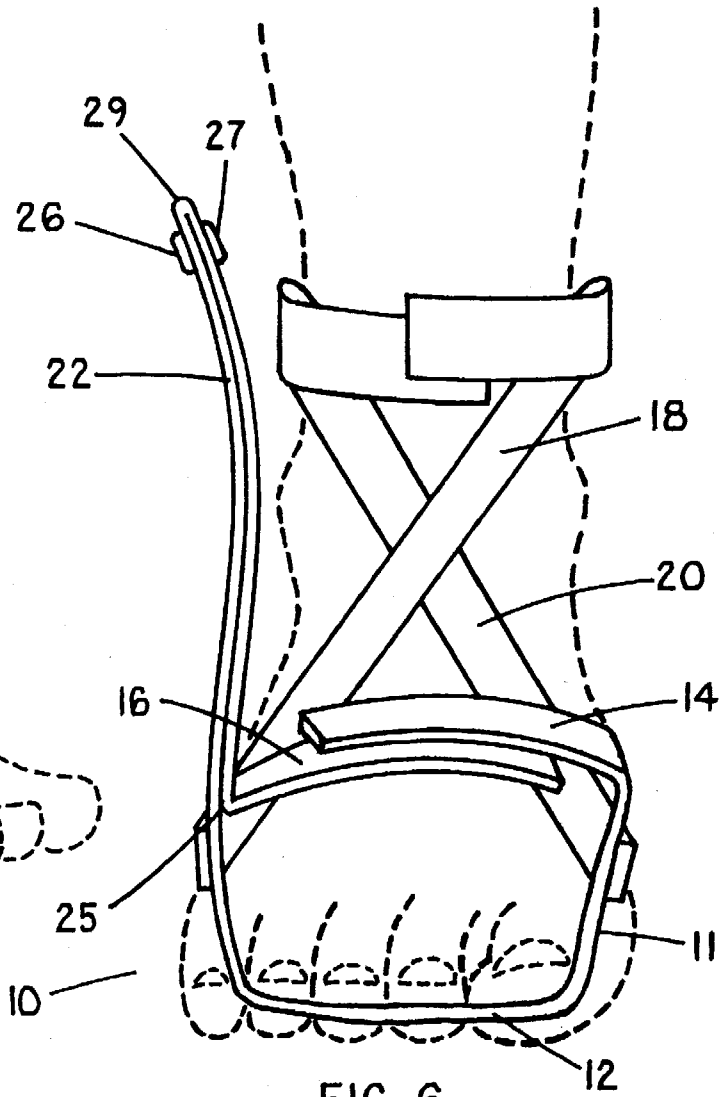
FIG. 6 is a view of the lateral side of an exercise apparatus of the invention.

Referring to FIGS. 5 and 6, a user forms the stirrup 11 by placing the long medial arch of the bottom of the foot over arch section 12. The lateral 18 and medial 20 ankle straps are at their respective side of the foot and typically lie rearward. The inner 14 and outward 16 stirrup straps are placed over the top of the foot and are removably attached to each other, preferably using interlocking fastening strips 15, 17 such as VELCRO®. Once the stirrup 11 forms, the user can remove the foot piece 10 without unfastening the stirrup 11 if desired, leaving an exercise apparatus that is similar to the one piece stirrup apparatus shown in FIG. 7.

The anklet 15 forms by crossing 21 the lateral 18 and medial 20 ankle straps behind the ankle and above the back of the heel. Although the lateral 18 and medial 20 ankle straps may fit loosely over the lateral and medial malleoli of the ankle, at this point the ankle straps are preferably located below or above the heel behind the lateral and medial malleoli. Next, the free ends of the ankle straps wrap above the ankle and removably attach to each other at the leg front, preferably using interlocking fastening strips 19, 21 such as VELCRO®. When using the preferred length of the lateral ankle strap, the end of the lateral ankle strap is either toward the back or the front of the ankle and away from the side for a neater appearance.

Similarly, the one piece exercise apparatus of FIG. 7 or the unfastened stirrup apparatus is used by first placing the foot into stirrup 51 with lateral ankle strap 58 and lateral strap 52 at the lateral side of the foot. Lateral strap 52 is located above lateral ankle strap 58. As described above, the anklet forms by crossing the lateral 58 and medial 60 ankle straps behind the the lateral and medial malleoli and above the back of the heel, then wrapping the free ends on the ankle straps above the ankle and removably attaching them to each other at the leg front such as by using interlocking fastening strips 59, 61.

Although the figures show the exercise apparatus worn on the foot, if desired, the exercise apparatus may be worn over footwear, such as shoes, boots or slippers.

The stirrup straps and ankle straps can be made with excess material. At the ends distal to the arch section, these straps can be finished with extra seams or other finishings that would prevent unraveling of the material when cut. Once fitted to the foot, the user can remove the excess strap material to allow a more comfortable fit, especially when wearing shoes over the stirrup and while exercising.

Figure 8:
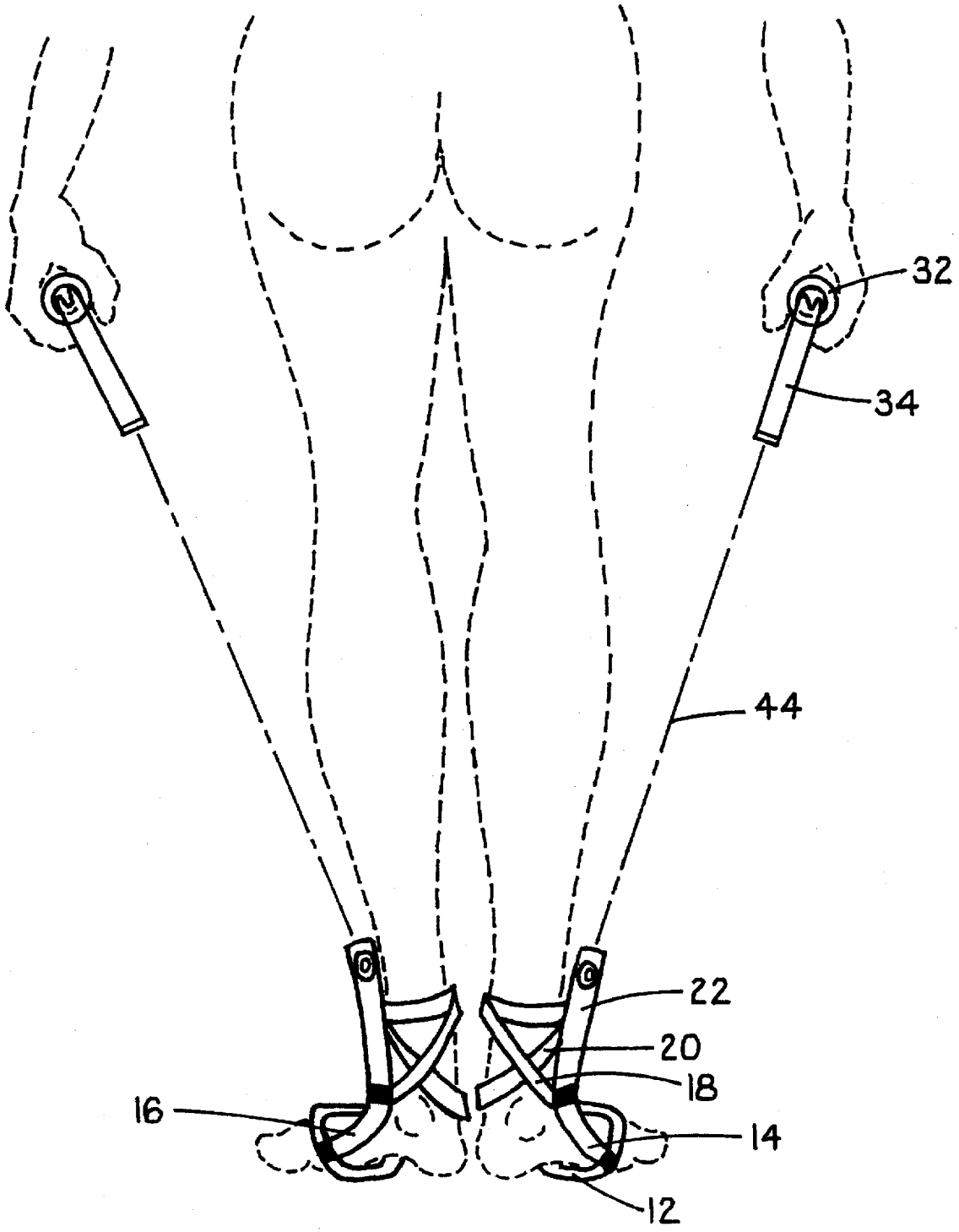
FIG. 8 is a rear view of an exercise apparatus of the invention in use.

FIG. 8 shows a user with the exercise apparatus in one exercise position. The user is wearing the apparatus on his feet, holding the handle in a thumb down position with the arm down. The elastic cord is taut but not stretched. From this position, the user is ready to start any number of exercises.

The exercise apparatus of the invention has several advantages. Anchoring the stirrup with the crossed ankle straps better distributes throughout the foot the force generated when exercising. This distribution reduces stress and the formation of pressure points. The ankle straps prevent the stirrup from rotating which eliminates the discomfort caused by the rotation.

Using a lateral strap allows the user to incorporate additional exercises with lateral and cross movements, such as curls and scissors. Because the position of the lateral strap is away from the anklet and stirrup while running or walking, it reduces the rubbing from the elastic cord against the leg.

The preferred rotatable hand grips allow the proper alignment of the exercise apparatus with the user's body. Rotating the grip allows the user to change the exercise position of the hand and forearm for a more thorough workout, such as palm up, palm down, thumb down or thumb up. This allows the user to choose his desired hand position and adjust the position for his body type. The rotating grip also generates little to no friction against the hand which reduces blisters and calluses. The rotating grip reduces hand fatigue and digging into the palm with the fingernails.

Therefore, the exercise apparatus of the invention simply and comfortably exercises the upper and lower body simultaneously, such as while walking or jogging.

The exercise apparatus of the invention is both lightweight and requires little space to store. The apparatus is easy to pack and carry when traveling.

The apparatus also allows a user to exercise in a limited space. One could exercise in a small area by running in place with the exercise apparatus. One could also incorporate the exercise apparatus into an exercise regimen that includes exercises performed while lying down, sitting or standing.

While the invention is shown in only one of its forms, it is not thus limited but is susceptible to various changes and modifications without departing from the spirit and scope of the invention.

What is claimed is:

1. An exercise apparatus comprising:

substantially parallel lateral and medial ankle straps;

an arch section defined by substantially perpendicularly affixing the lateral and medial straps to the arch section;

a lateral strap collinear to the arch section at the lateral ankle strap;

an inner stirrup strap collinear to the arch section at the medial ankle strap;

an outward stirrup strap substantially perpendicular to the lateral strap and opposite the ankle straps;

a handle; and an elastic cord fastened between the handle and the lateral strap.

2. An exercise apparatus of claim 1, wherein the handle has a rotatable grip and a handle strap.

3. An exercise apparatus of claim 2, wherein the lateral strap is made by folding a blank strap back upon itself distal to the inner stirrup strap and fastening a free end of the lateral strap at the arch section.

4. An exercise apparatus of claim 2, wherein the outward strap is made by folding a free end of the lateral strap and affixing the outward strap to the lateral strap.

5. An exercise apparatus of claim 2, further comprising:

an inner handle gap being formed by overlapping the ends of the handle strap and attaching at the ends to leave an opening in the overlapped section between the attached ends.

6. An exercise apparatus comprising:

a stirrup having lateral and medial sides and a top;

a medial ankle strap affixed to the medial side of the stirrup;

a lateral ankle strap affixed to the lateral side of the stirrup;

a lateral strap extending laterally from the stirrup toward the top and substantially perpendicular to the lateral ankle strap;

a handle; and an elastic cord attached to the lateral strap at one end and the handle at the opposite end.

7. An exercise apparatus of claim 6, wherein the handle has a rotatable grip and a handle strap.

8. An exercise apparatus of claim 7, wherein the lateral strap is made by folding a blank lateral strap back upon itself to form a fold distal to the stirrup and fastening a free end of the lateral strap.

9. An exercise apparatus of claim 7, further comprising:

an inner handle gap being formed by overlapping the ends of the handle strap and attaching at the ends to leave an opening in the overlapped section between the attached ends.

10. An exercise apparatus comprising:

a foot piece having an anklet and a stirrup;

the anklet having a medial ankle strap affixed to the medial side of the stirrup and a lateral ankle strap affixed to the lateral side of the stirrup, the ankle straps crossing behind an ankle and being removably attached together above the ankle;

a lateral strap extending laterally from the stirrup;

a handle; and an elastic cord attached to the lateral strap at one end and the handle at the opposite end.

11. An exercise apparatus of claim 10, wherein the handle has a rotatable grip and a handle strap.

12. An exercise apparatus of claim 11, wherein the lateral strap is made by folding a blank lateral strap back upon itself to form a fold distal to the stirrup and fastening a free end of the lateral strap.

13. An exercise apparatus of claim 11, further comprising:

an inner handle gap being formed by overlapping the ends of the handle strap and attaching at the ends to leave an opening in the overlapped section between the attached ends.

14. An exercise apparatus comprising:

a foot piece having an anklet and a stirrup;

the anklet having a medial ankle strap affixed to the medial side of the stirrup and a lateral ankle strap affixed to the lateral side of the stirrup, the ankle straps crossing behind an ankle and being removably attached together above the ankle;

the stirrup having an arch section being defined by the lateral and medial ankle straps, an inner stirrup strap extending from the medial side of the arch section toward the top of a foot, and an outward stirrup strap extending from the lateral side of the arch section toward the top of the foot, the inner and outer stirrup straps being removably attached together on top of the foot;

a lateral strap extending laterally from the stirrup;

a handle; and an elastic cord attached to the lateral strap at one end and the handle at the opposite end.

15. An exercise apparatus of claim 14, wherein the handle has a rotatable grip and a handle strap.

16. An exercise apparatus of claim 15, wherein the lateral strap is made by folding a blank strap back upon itself distal to the inner stirrup strap and fastening a free end of the lateral strap at the arch section.

17. An exercise apparatus of claim 15, wherein the outward strap is made by folding a free end of the lateral strap.

18. An exercise apparatus of claim 15, further comprising:

an inner handle gap being formed by overlapping the ends of the handle strap and attaching at the ends to leave an opening in the overlapped section between the attached ends.

* * * * *